United States Patent [19]

Okude et al.

[11] 4,217,786

[45] Aug. 19, 1980

[54] TRANSMISSION CABLE FOR USE WITH AN ULTRASONIC DEVICE

[75] Inventors: Kenzo Okude, Kokubunji; Koji Nirei, Tokyo, both of Japan

[73] Assignee: Nippon Electronics Limited, Tokyo, Japan

[21] Appl. No.: 945,995

[22] Filed: Sep. 26, 1978

[30] Foreign Application Priority Data

Jun. 13, 1978 [JP] Japan ..... 53-70415

[51] Int. Cl.[3] ..... B06B 3/00

[52] U.S. Cl. ..... 74/1 SS; 51/59 SS; 73/644; 82/DIG. 9; 116/137 A; 366/127

[58] Field of Search ..... 74/1 SS; 73/644; 82/DIG. 9; 51/59 SS; 116/137 A; 366/127; 174/24, 27, 110 AR; 339/28, 29 R, 117; 181/0.5

[56] References Cited

U.S. PATENT DOCUMENTS

| | | | |
|---|---|---|---|
| 1,986,789 | 1/1935 | Bennett | 174/24 |
| 3,023,547 | 3/1962 | Tesche | 51/59 SS |
| 3,352,376 | 11/1967 | Dory | 73/644 X |
| 3,562,401 | 2/1971 | Long | 174/27 X |
| 3,569,748 | 3/1971 | Minchenko et al. | 51/59 SS |
| 3,621,447 | 11/1971 | Taylor | 174/24 X |
| 4,003,620 | 1/1977 | O'Brien et al. | 339/29 R |

*Primary Examiner*—Allan D. Herrmann

*Attorney, Agent, or Firm*—Jordan and Hamburg

[57] ABSTRACT

A transmission cable for use with an ultrasonic device such as an ultrasonic machining device is provided. The transmission cable of the present invention comprises a plurality of fine metallic wires coupled between the output terminal of an ultrasonic oscillation generating source and the input terminal of a terminal machining tool of the ultrasonic device. The metallic wires are covered with a flexible tubular member which may preferably be filled with a liquid so that the lateral vibrations of the wires are suppressed thereby. This type of cable is particularly advantageous in that the ultrasonic oscillations of the wires forming the cable can be transmitted efficiently to the terminal machining tool and the cable is suitable and convenient for carrying out the ultrasonic machining operations with the machining tool.

5 Claims, 5 Drawing Figures

TRANSMISSION CABLE FOR USE WITH AN ULTRASONIC DEVICE

BACKGROUND OF THE INVENTION

The present invention relates to a transmission cable for use with an ultrasonic device such as an ultrasonic machining device and the like and, more particularly, to a transmission cable of the type that comprises a plurality of fine wires covered with a tubular member.

The conventional transmission cable used as a transmission medium for an ultrasonic device has been made of a single thick metallic wire. However, this kind of cable has such drawbacks that it is not always satisfactory in its way of transmitting ultrasonic oscillations efficiently to a terminal machining tool coupled to the cable and, moreover, it lacks flexibility and is therefore inconvenient for carrying out ultrasonic machining operations with the tool.

To overcome the above mentioned disadvantages of the conventional transmission cable, the present inventors have found, after experiments, that by use of a transmission cable comprising a plurality of fine metallic wires covered with a flexible tubular member, preferably that which is filled with a liquid, the ultrasonic oscillations effected by the ultrasonic device can be transmitted more efficiently than otherwise to the terminal machining tool coupled to the cable and further that this type of cable, since the tubular member is made of a flexible material, is easy to handle and therefore convenient for carrying out ultrasonic machining operations.

SUMMARY OF THE INVENTION

Accordingly, an object of the present invention is to provide a new and improved transmission cable for use with an ultrasonic device such as an ultrasonic machining device.

Another object of the present invention is to provide a transmission cable of the type that comprises a plurality of fine wires covered with a tubular member.

Further object of the present invention is to provide a transmission cable adopted to transmit ultrasonic oscillations effected by the ultrasonic device to a terminal machining tool coupled to the cable in an efficient manner.

Still further object of the present invention is to provide a transmission cable which is flexible and convenient for carrying out ultrasonic machining operations with the terminal machining tool.

As described, the transmission cable of the present invention comprises essentially a plurality of fine wires covered with a tubular member. The tubular member may be made of a flexible heat resistant material and may be filled with a liquid through which the wires pass so that the lateral vibrations of the wires are suppressed to thereby promote transmission efficiency of the cable.

BRIEF DESCRIPTION OF THE DRAWINGS

The features and details of the present invention will be more clearly apparent from the following description with respect to its preferred embodiments when taken in conjunction with the accompanying drawings in which like parts are designated by like reference numerals, and in which.

DESCRIPTION OF THE PREFERRED EMBODIMENTS

Figure 1:
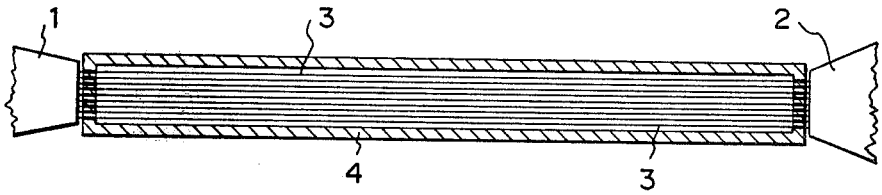
FIG. 1 is a longitudinal sectional view of a first preferred embodiment of the present invention.

Before entering into a specific description of the preferred embodiments of the present invention as shown in FIGS. 1 to 4, it is to be noted that the cable of the present invention generally comprises, throughout all the embodiments, a plurality of fine metallic wires 3 of equal length covered with a tubular member 4. A numeral 1 indicates an output terminal of an ultrasonic oscillation generating source coupled to one end of the cable and a numeral 2 indicates an input terminal of a terminal machining tool coupled to the other end of the cable. Each of said fine wires may preferably be made of metal such as carbon steel having a diameter of about 0.3 to 2 mm. It is desirable that the diameter of each wire be comparatively small in consideration of the fluctuation and fall of the transmission efficiency of the cable, as well as of its flexibility. On the contrary, it has been found after experiments that in case the wire becomes too small in diameter, the lateral vibrations become great and the ultrasonic oscillations effected by the ultrasonic device can not be transmitted efficiently to the terminal machining tool. Therefore, the optimum diameter of the wire which satisfies the above mentioned conditions in actual practice is in the range of about 0.3 to 2 mm as aforesaid.

The tubular member 4 may preferably be made of a flexible material such as synthetic rubber like silicone rubber, natural rubber, synthetic resins like fluorine-contained resin, glass fiber, cotton or jute. Further, it is desirable that the tubular member have some degree of heat resistant property because of the fact that the portions at which each wire 3 comes into contact with the tubular member 4 tend to become heated, due to an ultrasonic energy, to a temperature as high as 100° C.

Figure 2:
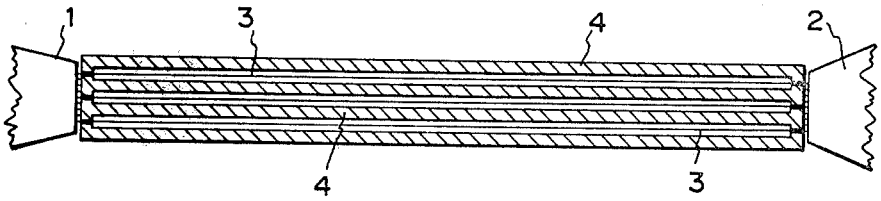
FIG. 2 is a longitudinal sectional view of a second preferred embodiment of same.
Figure 4:
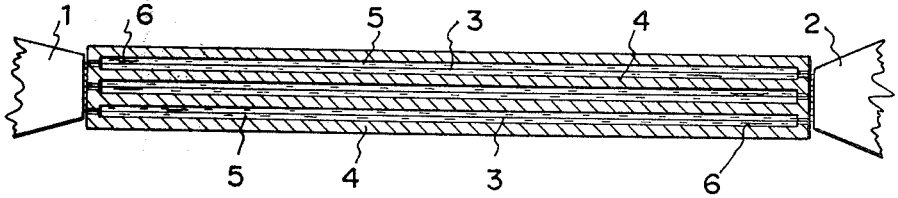
FIG. 4 is a longitudinal sectional view of a fourth preferred embodiment of same.

As shown in FIGS. 2 and 4, the tubular member 4 may have a plurality of hollow passages provided within, and extending parallel to, the outer wall of the tubular member throughout the entire length of the latter so that the wires 3 can individually pass through said hollow passages and oscillate therewithin. Such a structure is particularly advantageous in that the wires 3 are prevented from running against one another when they vibrate in the lateral direction.

Figure 3:
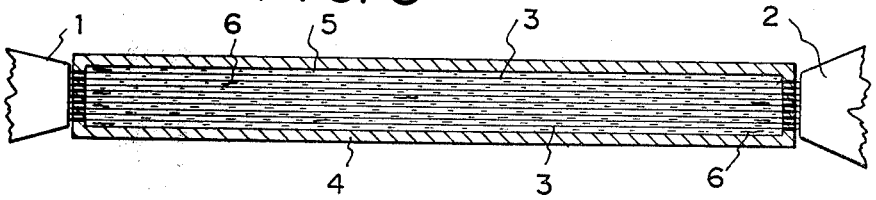
FIG. 3 is a longitudinal sectional view of a third preferred embodiment of same.

Further, as shown in FIGS. 3 and 4, the tubular member 4, or the hollow passages therewithin, may be filled with a suitable liquid 5 such as silicone oil so as to suppress the wires to vibrate in the lateral direction. The viscosity of the liquid 5 may desirably be of 1 to 150 centipoise because, when the viscosity of the liquid is too high, not only the lateral vibrations of the wires 3 but also the required ultrasonic oscillations thereof are suppressed. On the other hand, when the viscosity is too low, the lateral vibrations of the wires 3 can not be suppressed enough and, therefore, the required ultrasonic oscillations can not be transmitted efficiently to the terminal machining tool. In this case, it is recommendable that since the liquid 5 can not be completely sealed within the tubular member 4 due to ultrasonic oscillations of the wires 3, a fibrous filler material 6 be inserted into the tubular member to thereby keep the leakage of the liquid from both ends of the tubular member at a minimum.

Figure 5:
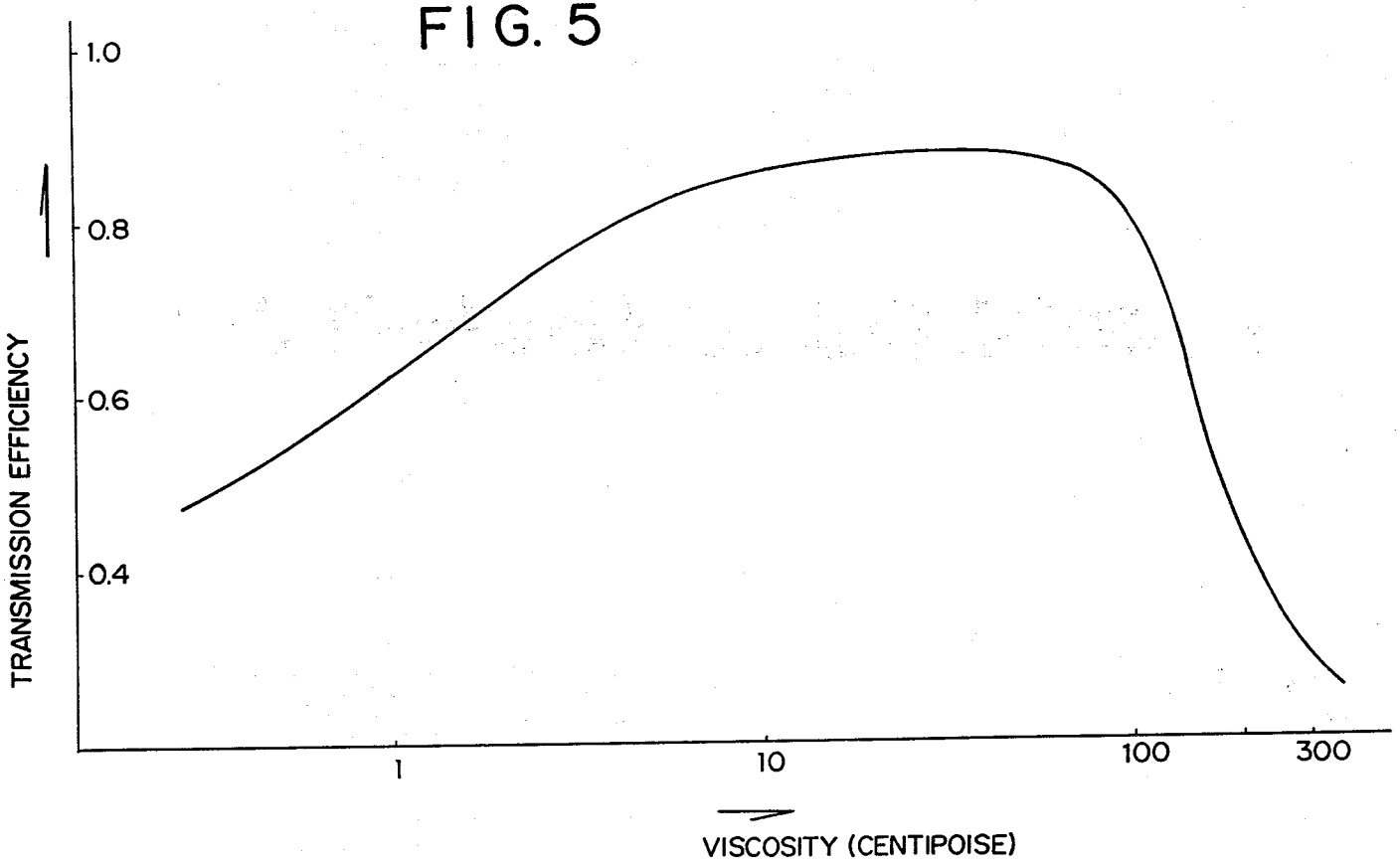
FIG. 5 is a graph showing the transmission efficiency of the cable according to the present invention plotted against variations of the viscosity of a liquid filled into the cable.

The relationship between the viscosity of the liquid 5 filled into the tubular member 4 and the transmission efficiency of the cable is shown by a graph in FIG. 5. As will be understood from the graph, the optimum viscosity of the liquid filled into the tubular member is in the range of about 5 to about 100 centipoise.

As a result of experiments conducted by the inventors with respect to the above four embodiments, it has been found that the transmission cable as shown in FIG. 1 is inferior to that as shown in FIG. 2 in that in the case of the former, the wires 3 run against one another accompanied with disagreeable metallic sounds during ultrasonic machining operations and, moreover, the transmission efficiency of the cable decreases. On the contrary, it has also been found that there is no difference in transmission efficiency between the transmission cables as shown in FIGS. 3 and 4. This is apparently due to the existence of the liquid 5 (such as silicone oil) around each of the wires 3 irrespective of whether the wires are housed within the same single clearance in the tubular member or housed individually within the plurality of passages therein as shown. In conclusion, when the embodiments in FIGS. 1 to 4 are compared with one another, it can be said that the transmission cables as shown in FIGS. 3 and 4 are most excellent and then follow those as shown in FIGS. 2 and 1, respectively in that order. For example, in the case of the transmission cable as shown in FIG. 2 in which the tubular member 4 is not filled with any liquid, the transmission efficiency thereof is nearly equal to that of the cable in which the tubular member 4 is filled with the liquid 5 of about 0.2 centipoise in viscosity when the graph in FIG. 5 is referred to. However, it is to be noted that even the transmission cable in FIG. 1 is far more excellent than a cable which comprises only a plurality of fine metallic wires with no tubular member surrounding same.

As described above, the transmission cable of the present invention has various advantages that since the lateral vibrations of the wires forming the cable are suppressed by the specific structure of the tubular member surrounding the wires or by the liquid filled within the tubular member, the ultrasonic oscillations of the wires can be transmitted to the terminal machining tool more efficiently than otherwise, and that since the tubular member is made of a flexible material, the cable is convenient for carrying out ultrasonic machining operations with the tool.

Lastly, although the present invention has been illustrated and described with reference to its preferred embodiments, it is nevertheless not intended to be limited thereto since various modifications and changes may be made without departing from the spirit and scope of the present invention.

What is claimed is:

1. A transmission cable for the transfer of ultrasonic vibration energy comprising a plurality of wires of equal length extending between an ultrasonic vibration energy source and a terminal working tool, and a flexible tubular member for housing said wires, said wires passing through said tubular member in spaced apart relationships with one another and said tubular member being filled with a liquid having a viscosity of 1 to 150 centipoises, whereby lateral deflections of said wires are suppressed.

2. A transmission cable as claimed in claim 1 in which said tubular member is provided with a plurality of hollow passages filled with said liquid and extending parallel to one another throughout the length of said tubular member and said wires pass through said passages, respectively.

3. A method for transferring ultrasonic vibration energy through s plurality of wires between an ultrasonic vibration energy source and a terminal working tool, comprising the steps of passing said wires in spaced apart relationship through a flexible tubular member, maintaining a liquid having a viscosity of 1 to 150 centipoises in said tubular member, and suppressing lateral deflection of said wires utilizing said liquid in said tubuler member.

4. A method according to claim 3 further comprising passing said wires through parallel hollow passages in said tubular member, and containing said liquid in said hollow passages.

5. A method of suppressing lateral deflection of wires used for transmitting ultrasonic vibration energy between an ultrasonic vibration energy source and a terminal working tool, comprising the steps of passing said wires through a housing containing a liquid, and utilizing said liquid in said housing to suppress lateral deflection of said wires as the latter transmits ultrasonic vibration energy between said ultrasonic vibration energy source and said terminal working tool.

* * * * *